US005094037A

United States Patent [19]

Hakomori et al.

[11] Patent Number: 5,094,037

[45] Date of Patent: Mar. 10, 1992

[54] EDGE POLISHER

[75] Inventors: Shunji Hakomori, Tokyo; Seiichi Maeda, Ayase; Isao Nagahashi, Fujisawa, all of Japan

[73] Assignee: Speedfam Company, Ltd., Kanagawa, Japan

[21] Appl. No.: 588,459

[22] Filed: Sep. 26, 1990

[30] Foreign Application Priority Data

Oct. 3, 1989 [JP] Japan ..... 1-258505

[51] Int. Cl.[5] ..... B24B 49/00

[52] U.S. Cl. ..... 51/165.77; 51/283 E; 51/215 AR; 51/237 T; 51/327

[58] Field of Search ..... 51/165.77, 215 R, 215 AR, 51/237 T, 283 E, 108 R, 326, 327, 240 R, 240 T; 29/37 R, 35.5, 36, 38 R, 38 A, 38 B, 564; 414/754, 758, 764, 765, 771, 733, 783

[56] References Cited

U.S. PATENT DOCUMENTS 3,399,498 9/1968 Lampani et al. ..... 51/215 AR
4,002,247 1/1977 Dixon ..... 414/771
4,057,149 11/1977 Clarke ..... 414/773
4,630,403 12/1986 Belthle ..... 51/237 T
4,864,779 9/1989 Ozaki ..... 51/283 E
4,905,425 3/1990 Sekigawa et al. ..... 51/283 E

*Primary Examiner*—M. Rachuba
*Attorney, Agent, or Firm*—Allegretti & Witcoff, Ltd.

[57] ABSTRACT

Described herein is an edge polisher for polishing chamfered edge portions on the front and rear sides of work, including a first machining stage for polishing the front side of work and a second machining stage for polishing the rear side of work, along with mechanisms for supplying, positioning, transferring, reversing and ejecting work. In the first and second machining stages, a work is chucked on each of index units which are mounted on an intermittently rotating index table and revolved around a polishing drum located at the center of the index table, pressing chamfered edge portions of the works against the polishing drum to give a polishing treatment thereto.

14 Claims, 12 Drawing Sheets

EDGE POLISHER

<BACKGROUND OF THE INVENTION>

1. Field of the Invention

This invention relates to an edge polisher for mirror-polishing chamfered edge portions of a work, for example, chamfered marginal edge portions of semiconductor wafers, glass sheets, quartz sheets, ceramic substrates and the like.

2. Description of the Prior Art

For instance, semiconductor wafers such as silicon wafers normally have their marginal edges chamfered for the purpose of preventing edge chipping and precluding crowning in epitaxial growth.

However, subsequent to the chamfering which employs diamond abrasive grains for the grinding operation, a machining distortion layer tends to remain on the work, giving rise to various problems as follows. Namely, such a machining distortion layer which remains after a grinding operation is likely to invite the so-called crystal sliding phenomenon in a device process due to the thermal stress resulting from repeated heat treatments, or fracturing of edge portions by the impacts imposed by a quartz board on which the work is transferred between various processes, producing refuse of fractured fragments which would lead to a drop in yield, defoliation of oxidation film, degradation in washability, deterioration of resist flows at edge portions and so forth.

Therefore, it has been the usual practice to remove such machining distortion layers by etching. However, etched surfaces contain wavy or scale-like irregularities which are susceptible to fouling. Especially, even a slight degree of fouling which remains in a chamfered portion might diffuse to the entire wafer in a device process to deteriorate the wafer characteristics.

Under these circumstances, the present inventors succeeded in solving these problems by developing an apparatus for mirror-polishing chamfered edge portions of wafers, as proposed in Japanese Laid-Open Patent Application 64-71656.

The polishing apparatus of the above-mentioned application, which is arranged to polish wafers one by one, has an advantage that it can be applied in a compact form for small-scale wafer treatments, but in terms of efficiency it is unsuitable for wafer treatments on a large scale. Therefore, there have been demands for a polisher which is capable of concurrently treating a plural number of wafers.

<SUMMARY OF THE INVENTION>

It is an object of the present invention to provide an edge polisher of high productivity, which is capable of polishing chamfered edge portions of a plural number of works simultaneously and continuously.

According to the invention, for achieving the above-stated objective, there is provided an edge polisher which essentially includes: a loader section for feeding works each having chamfered edge portions on the opposite sides thereof; a positioning mechanism for delivering the works to a predetermined stand-by position; first and second machining stages each having an index table adapted to rotate intermittently through a predetermined angle, a plural number of index units each having a motor-driven work chuck means and located at predetermined angular intervals about the center of rotation of the index table, and a polishing drum located at the center of rotation of the index table and rotationally driven from a motor, each one of the index units being revolved around the polishing drum by rotation of the index table, pressing chamfered edge portions of a work on the chuck means against the polishing drum; a first transfer mechanism adapted to transfer the works in the predetermined stand-by position successively to an index unit in the first machining stage; a reversing mechanism adapted to reverse the work upside down after finishing a polishing treatment on the chamfered edge portions in the first machining stage; a second transfer mechanism adapted to eject the work after finishing a polishing treatment on the chamfered edge portions in the second machining stage; and an unloader section for unloading polished works from the polisher.

The above-mentioned positioning mechanism is preferably constituted by a rotatable chuck table which is capable of releasably holding a work for delivery to the stand-by positions, and a sensor means for detecting an orientation flat of each work, stopping the rotation of the chuck table at a position where the orientation flat is detected. This permits polishing of non-circular works with an orientation' flat.

According to the invention, each index unit in the first and second machining stages is constituted by a support wall freely movable along a rail extending in a radial direction of the index table, and a unit body having the above-mentioned chuck means and tiltably mounted on the support wall. The index unit and the unit body are biased toward the center of the index table and in the tilting direction, respectively, thereby pressing the chamfered portions of a work against the polishing drum except an index unit in a work hand-over position. In the work hand-over position, the index unit is moved toward the outer periphery of the index table by a carrier means while adjusting the posture of the unit body into a horizontal position by a tilt cancelling mechanism.

The biasing means which urges the unit body in the tilting direction is constituted by a tension spring which is stretched between the unit body and the support wall, and the biasing means which urges each index unit toward the center of the index table is constituted by a weight attached to the fore end of a rope which is fixed to the index unit at its base end.

The index table is provided with a pin member which is movable into a protruded position when a work is not gripped in the chuck means, thereby restricting the movement of the index unit to prevent the chuck means from hitting against the polishing drum.

The carrier means which transfer the index unit toward the outer periphery of the index table is constituted by a cam groove, and a cam follower which is provided on the part of the index unit, the cam and cam follower being engaged with each other when the index unit is in the work hand-over position.

The tilt cancelling mechanism of the index unit is constituted by a stopper which is mounted on the index table, and a rocking block which is mounted on the unit body. As the index unit is turned toward the work hand-over position and simultaneously moved toward the outer periphery of the index table, the rocking block is abutted against the stopper to adjust the posture of the unit body into a horizontal position.

The chuck means which is provided on the index unit for gripping a work is constituted by a pair of upper and lower circular chuck members which are movable toward and away from each other. In this instance, the lower chuck member is preferably formed in a larger diameter than the upper chuck member to prevent cracking of the work which might otherwise occur when pressed against the polishing drum.

The above and other objects, features and advantages of the invention will become apparent from the following description and the appended claims, taken in conjunction with the accompanying drawings.

<DESCRIPTION OF PREFERRED EMBODIMENTS>

Figure 4A:
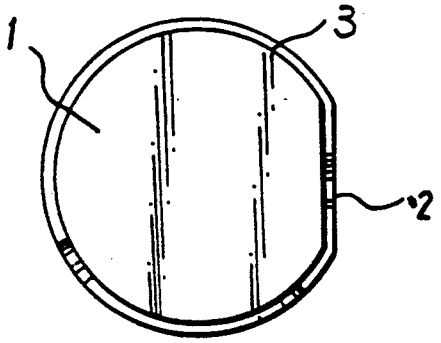
FIG. 4(A) is a schematic plan view of a wafer to be polished.

Hereafter, the invention is described more particularly by way of the preferred embodiments shown in the drawings. The following embodiment of the invention is arranged to be able to treat not only a work of a complete circular shape but also a work of an incomplete circular shape, for example, a work 1 of an incomplete circular shape which is provided with an orientation flat 2 and chamfered edge portions 3 on the opposite sides as shown in FIG. 4.

Figure 1:
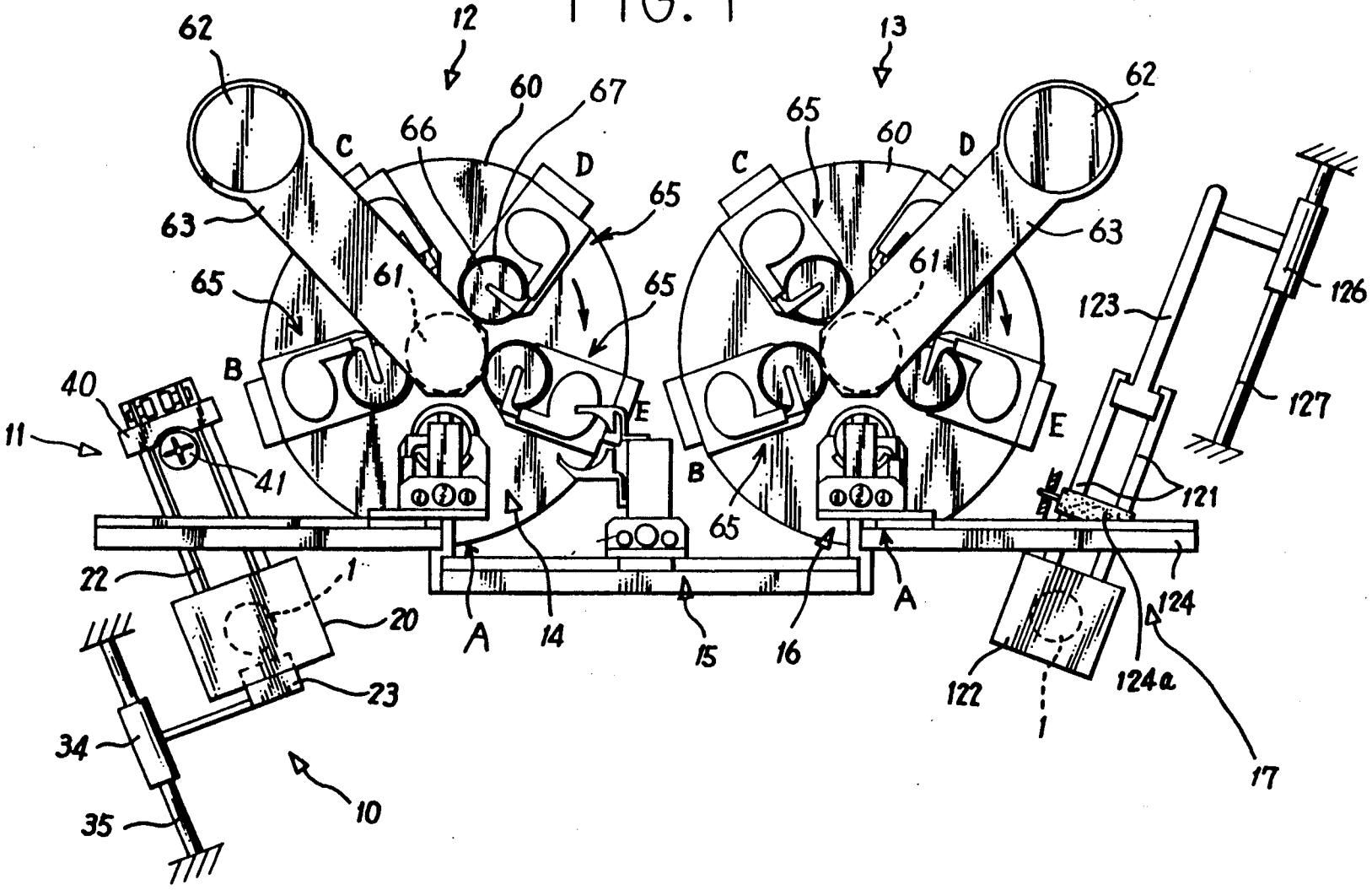
FIG. 1 is a schematic plan view of an edge polisher embodying the present invention.
Figure 2:
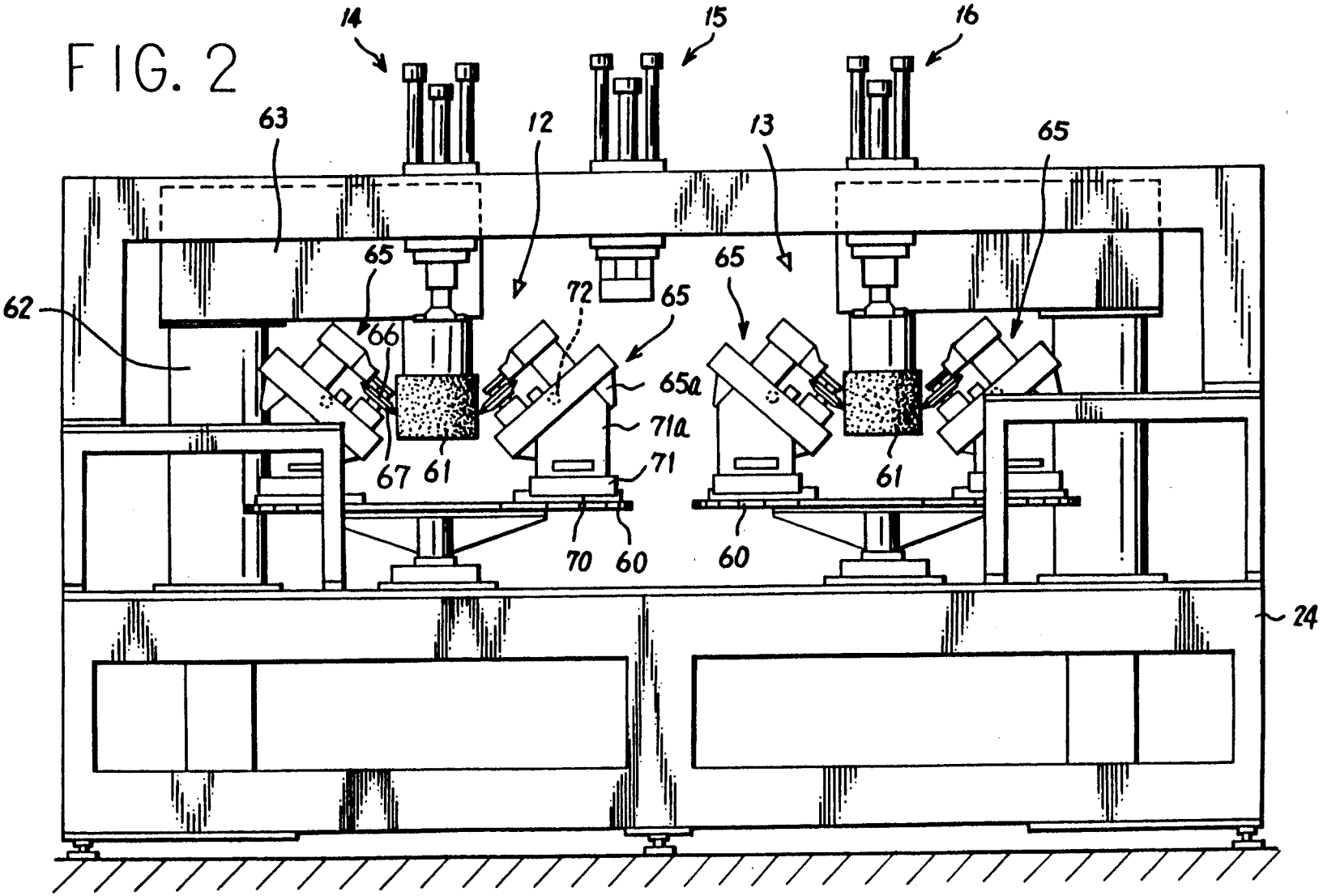
FIG. 2 is a partly cutaway front view of the edge polisher.
Figure 3:
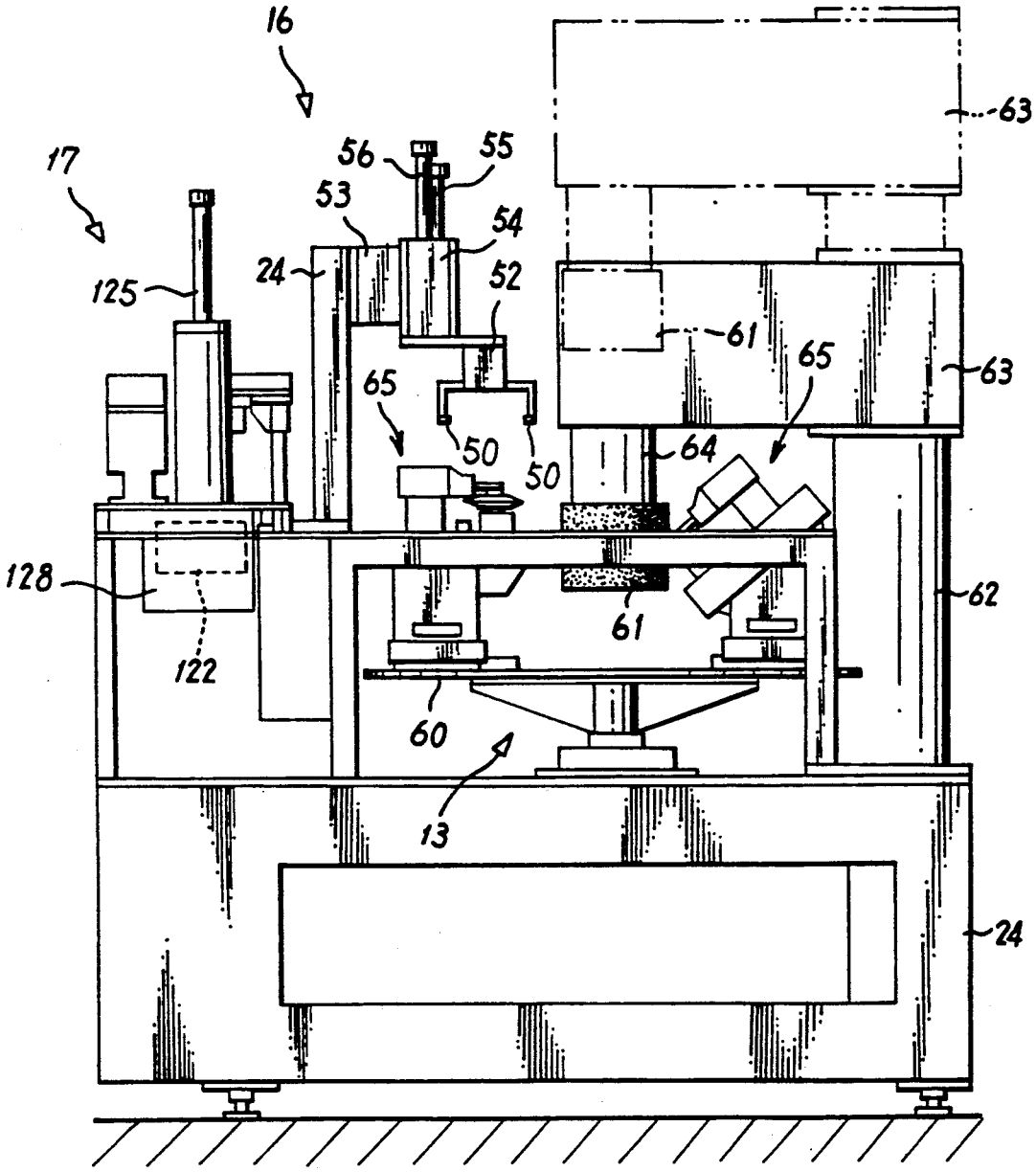
FIG. 3 is a schematic side view of the edge polisher.

Namely, the edge polisher shown in FIGS. 1 to 3 basically consists of: a loader section 10 for feeding works 1; a positioning mechanism 11 for arraying the works 1 supplied from the loader section in a predetermined stand-by position; a first machining stage 12 for polishing chamfered edge portions 3 on one side of the works; a second machining stage 13 for polishing chamfered edge portions 3 on the other side of the works 1; a first transfer mechanism 14 for supplying the works 1 in the stand-by position successively to the first machining stage 12; a reversing mechanism for turning a work 1 upside down after finishing a polishing treatment in the first machining stage and supplying the reversed work 1 to the second machining stage 13; a second transfer mechanism 16 for ejecting the work 1 after finishing a polishing treatment in the second machining stage; and an unloader section provided with a cassette to receive polished workpieces 1 from the second transfer mechanism 16.

Figure 5:
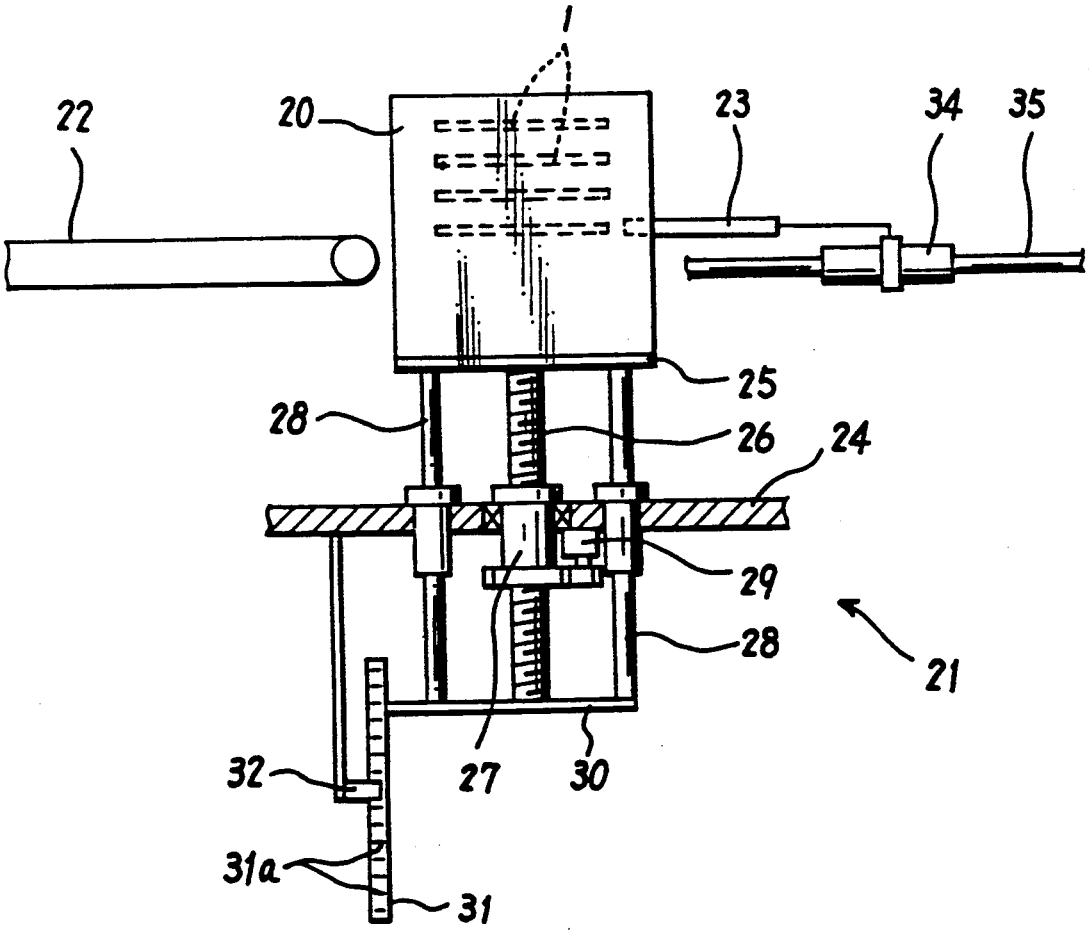
FIG. 5 is a schematic side view of a loader.

As seen in FIGS. 1 and 5, the loader section 10 includes a lift mechanism 21 for a feeder cassette 20 which accommodates a stack of works 1 therein, a conveyer 22 for transferring the works 1, and a pusher 23 for pushing the works 1 in the cassette 20 onto the conveyer 22 one after another. The lift mechanism 21 includes a ball screw 26 which is securely fixed to a bottom plate 25 and threaded into a drive member 27 with a gear, which drive member 27 being rotatably supported on a machine frame 24, and a guide shaft 28 which is located parallel with the ball screw 26 and slidably supported on the machine frame 24. Upon rotating the drive member 27 by a motor 29, the bottom plate 25 is moved up and down under the guidance of the guide shaft 28. A connector plate 30 which is fixed to the lower ends of the ball screw 26 and guide shaft 28 is provided with a scale 31 with a large number of slits 31*a* at predetermined intervals along the length thereof. On the other hand, provided on the machine frame 24 is an optical sensor 32 for reading the slits 31*a* on the scale 31. Therefore, the slits 31*a* are read in by the optical sensor 32 as the cassette 20 is lowered step by step from an upper lifted position, sending out the works 1 onto the conveyer 22 one after another by the pusher 23 which is driven by a rodless cylinder 34. In FIGS. 1 and 5, the reference numeral 35 denotes a guide rod which guides the movement of the rodless cylinder 34.

Figure 6:
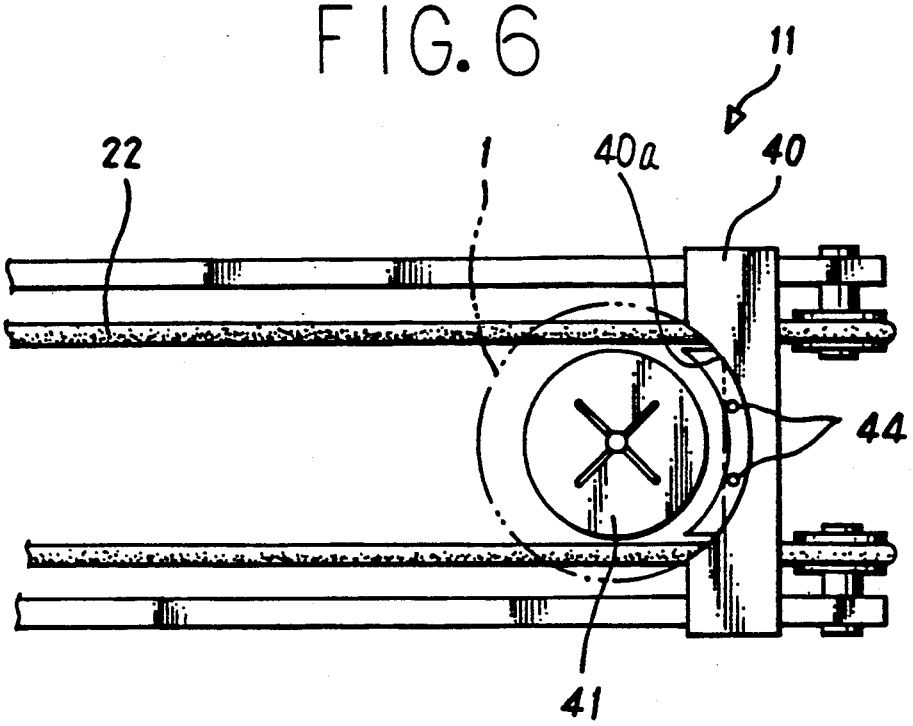
FIG. 6 is a schematic plan view of a positioning mechanism.
Figure 7:
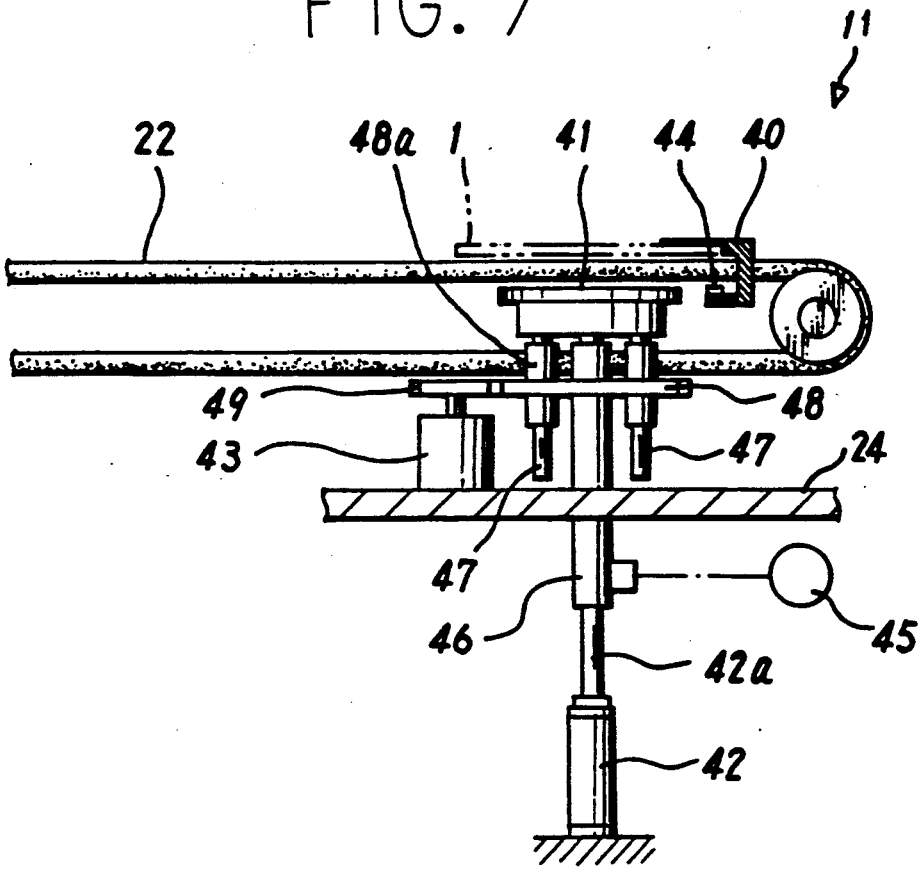
FIG. 7 is a schematic side view of the positioning mechanism.

The positioning mechanism 11 which is located at the fore end of the conveyer 22 includes, as shown in FIGS. 6 and 7, a stopper 40 which is located at the end of the conveyer 22 to stop a work 1 which has been transferred by the conveyer 22, a chuck table 41 which is located at a work stop position and adapted to chuck the work 1 by means of vacuum supplied from a vacuum source 45, and a couple of optical sensors 44 for detecting an orientation flat 2 of the work 1. The chuck table 41 is rotatably mounted on the upper end of rod 42*a* of a cylinder 42 and moved up and down by stretching and contracting the cylinder rod 42*a*. This rod 42*a* is slidably supported in a bearing member 46 which is fixed on the machine frame 24. Mounted rotatably on the bearing member 46 is a toothed support disc 48 which is coupled with the motor 43 through a gear 49. In turn, mounted on the support disc 48 are bearing members 48*a* which slidably support guide rods 47 extending downwardly from the lower side of the chuck table 41. It follows that the chuck table 41 is movable up and down by operation of the cylinder 42 and at the same time rotationally driven from the motor 43 through the support disc 48.

Accordingly, as a work 1 is transferred to the positioning mechanism 11 and stopped at the position of the stopper 40, the chuck table 41 is lifted up by the cylinder 42 to chuck the work 1 and turned slowly. Then, as soon as the orientation flat 2 of the work 1 is detected by the two optical sensors 44, the rotation of the chuck table 41 is stopped at that position to orient the work 1 in a predetermined direction. In this instance, it is desirable to slow down the speed of rotation of the work 1 when the orientation flat 2 is detected by one of the optical sensors 44.

Figure 8:
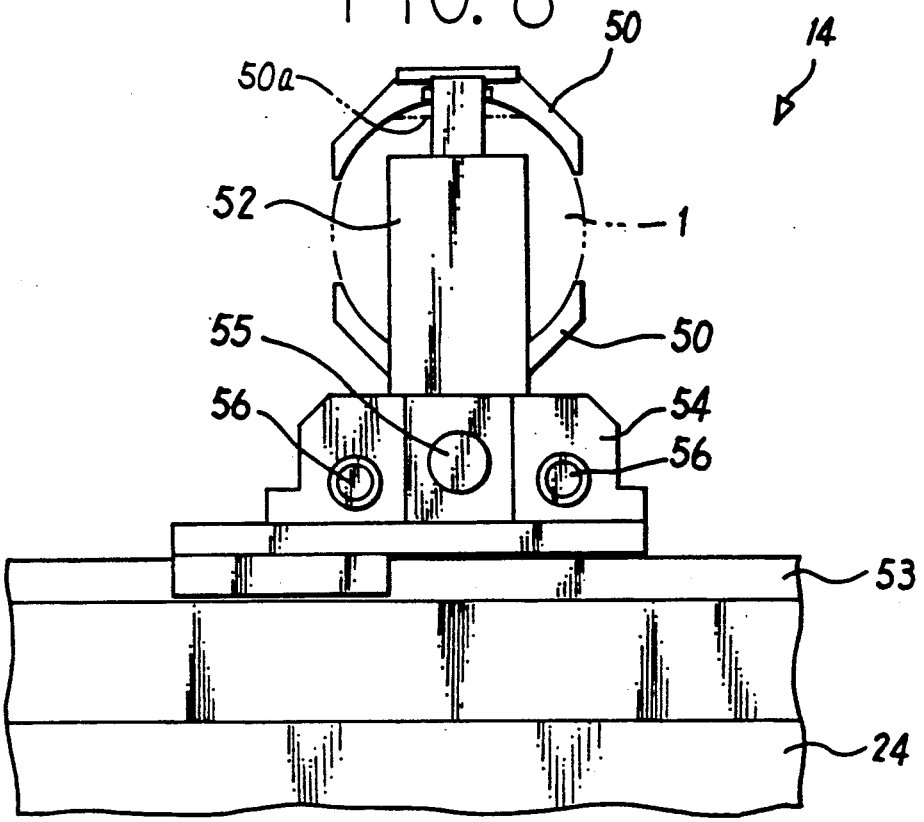
FIG. 8 is a schematic plan view of a transfer mechanism.
Figure 9:
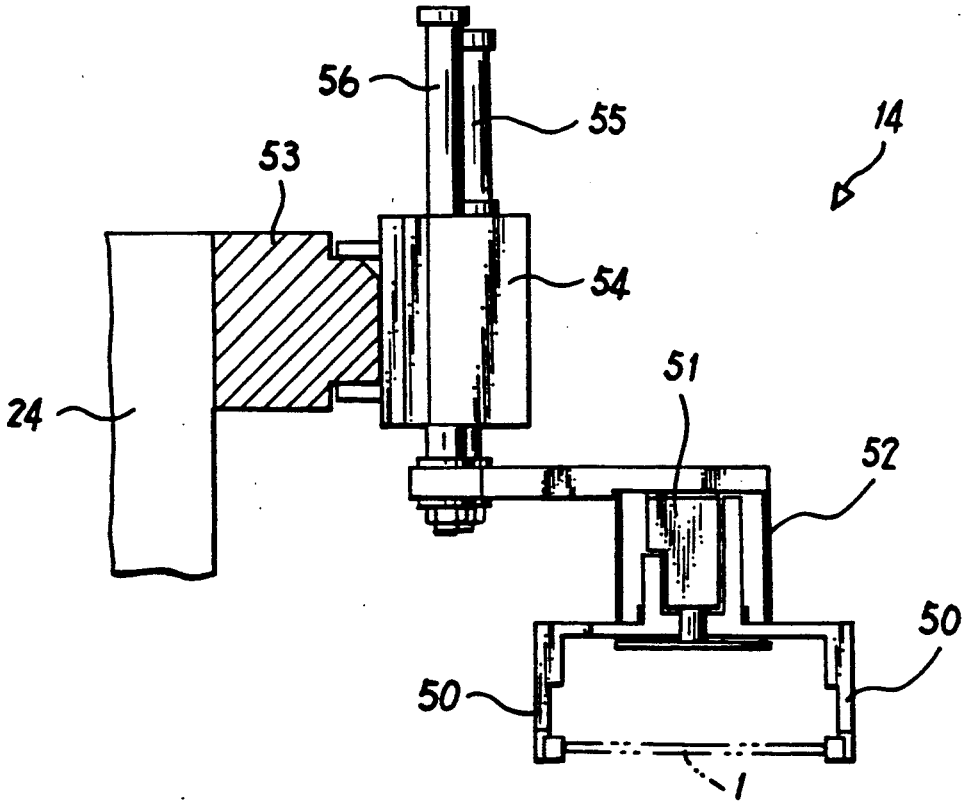
FIG. 9 is a schematic side view of the transfer mechanism.

The work 1 which has been located in a predetermined position by the above-described positioning mechanism 11 is then supplied to the first machining stage 12 by the first transfer mechanism 14 which is constituted by, as shown particularly in FIGS. 8 and 9, a pair of grippers 50 which are openably closed by operation of a cylinder 51 to hold therebetween the work 1 at radially opposite outer peripheral surfaces thereof. These grippers 50 are mounted on a support member 52 which is vertically movably supported on a cylinder 55 which is in turn mounted on a slide member 54, for upward and downward movements under the guidance of a guide rod 56. As indicated by chain line in FIG. 8, one of the grippers 50 is provided with a linear portion 50*a* to be brought into abutting engagement with the orientation flat 2 of the work 1. Therefore, the work 1 can be oriented exactly in the predetermined direction by the grippers which are arranged to hold the orientation flat and a diametrically opposite portion of the work 1.

Figure 10:
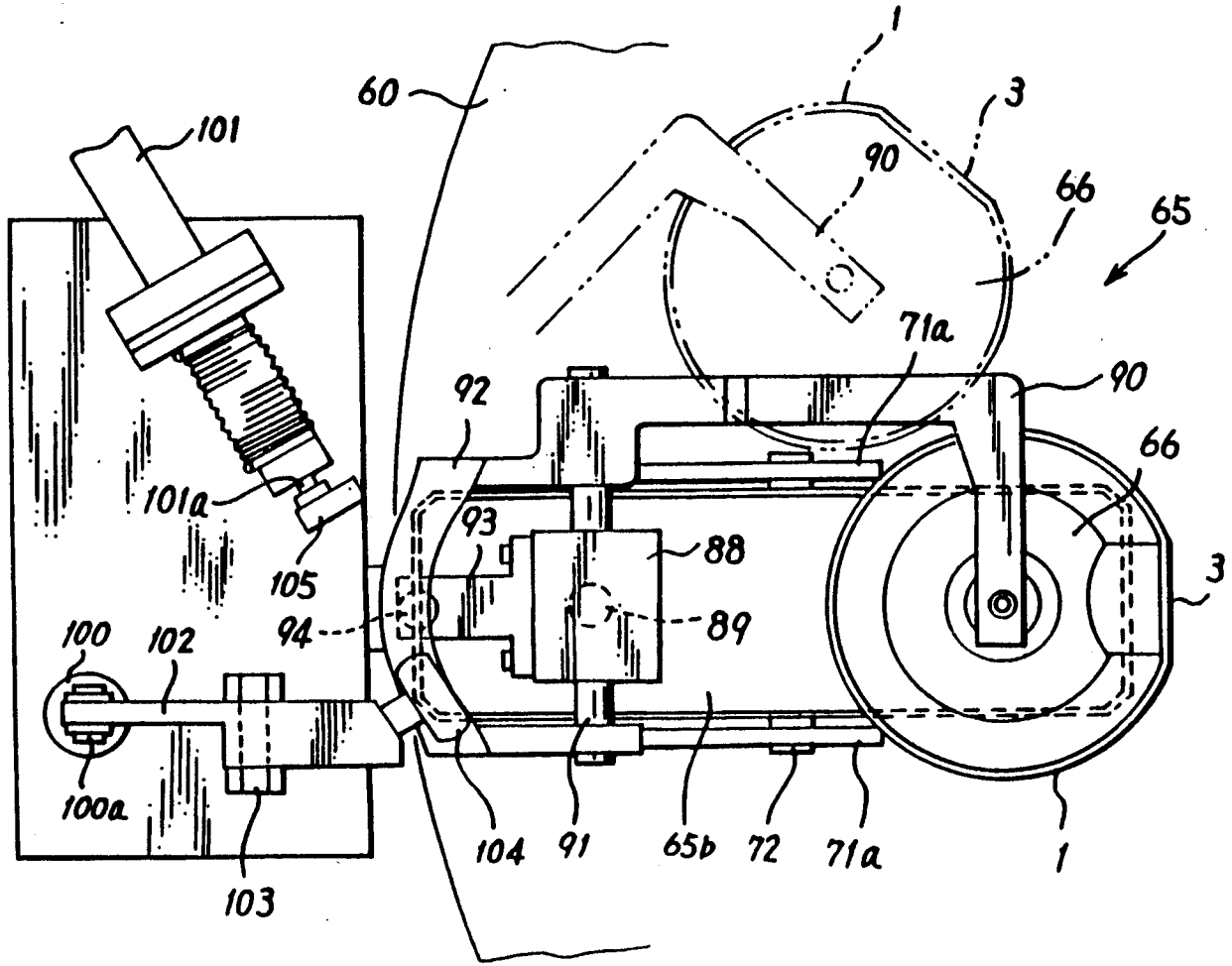
FIG. 10 is a schematic plan view of an index unit.

The first machining stage 12 includes, as shown in FIGS. 1 to 3, an index table 60 which is rotatably supported on the machine frame 24, a polishing drum 61 located at the center of the index table by a support column 62 which is erected on the machine frame 24 to support a drum shaft 64 on a support arm 63, and a plural number of index units 65 which are located at predetermined intervals on the index table 60 and movable in radial directions of the index table and at the same time tiltable toward the center of the index table through a predetermined angle to press against the polishing drum 61 the chamfered edge portions 3 of the works 1 which are gripped between upper and lower disc-like chuck members 66 and 67 of the respective index unit for polishing the edge portions. (FIG. 11) As seen in FIG. 10, the upper and lower chuck members 66 and 67 are provided with a linear portion at the respective outer peripheries in a position corresponding to the orientation flat of the work 1.

Figure 11:
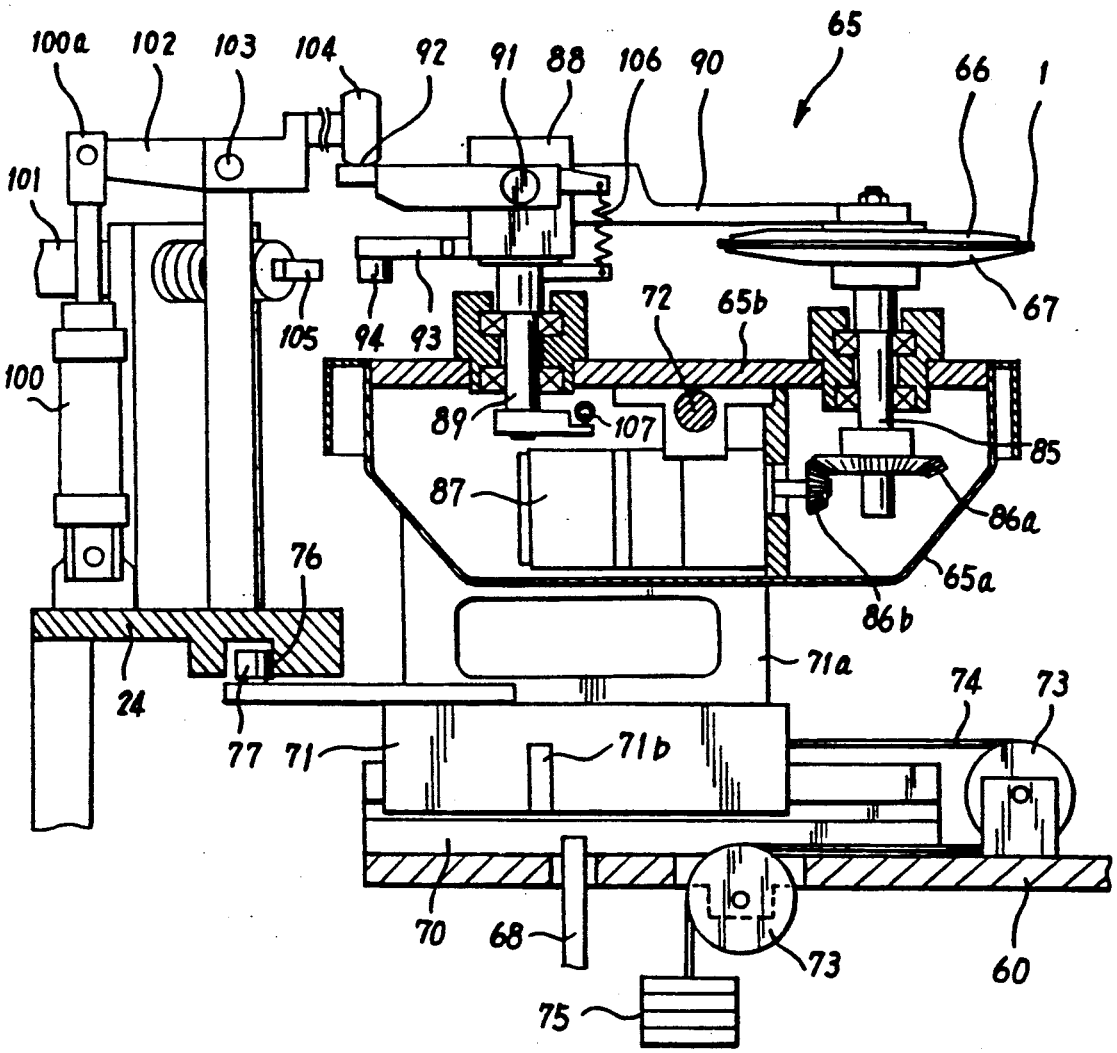
FIG. 11 is a vertical section of the index unit.

The index table 60 is driven intermittently to rotate through a predetermined angle each time, namely, through an angle corresponding to the interval between the adjacent index units 65, by means of a cylinder, a link mechanism and a one-way clutch which are omitted in the drawings. As shown in FIGS. 2, 10 and 11, provided on the index table is a profiling mechanism including a rail 70 and a slider 71 which is slidable along the rail 70 in a radial direction of the table. A main unit body 65*a* of the index unit 65 is tiltably supported on a horizontal shaft 72 which is extended in a direction perpendicular to the rail 70 and between a pair of upright support walls 71*a* uprising from the slider 71. Accordingly, as mentioned hereinbefore, the unit body 65*a* is movable in the radial direction of the index table and at the same time tiltable toward the polishing drum 61 by a rocking movement about the horizontal shaft 72.

As shown particularly in FIG. 11, each index unit 65 is constantly urged toward the center of the index table 60 by a weight 75 hanging down from the fore end of a rope 74 which is lapped around pulleys 73. Except an index unit in the work hand-over position A shown in FIG. 1, the index units 65 are moved inward on the table 60, pressing the works 1 against the polishing drum 61 with a predetermined force. Further, even if the work 1 is of an incomplete circular shape as shown, each index unit 65 is moved in the radial direction of the index table 60 according to the work shape to press the work 1 against the polishing drum 61 always with the same force determined by the weight 75.

The index unit 65 in the work hand-over position A is moved radially outward of the index table 60 by a cam mechanism, keeping the work 1 away from the polishing drum 61.

The above-mentioned cam mechanism is constituted, as shown in FIG. 11, by a cam groove 76 which is formed on the machine frame 24 only at the work hand-over position, and a cam follower 77 which is formed on the slider 71 of each index unit 65. As any one of the index units 65 is revolved to the work hand-over position A by the intermittent rotation of the index table 60, the cam follower 77 of that index unit 65 is brought into engagement with the cam groove 76, whereupon the index unit 65 is moved slowly along the cam groove 76 in a direction outward of the index table 60.

In order to prevent the upper and lower chuck members 66 and 67 from hitting against the polishing drum 61 when they are in empty state, a sensor means which detects the existence or absence of a work between these chuck members is provided on the index unit 65 or on the transfer mechanism 14. To this end, it is preferable to provide a pin 68 which is protrudable from the surface of the index table 60 into engagement with a stopper 71*b* on the part of the slider 71 when there is no work between the chuck members 66 and 67.

Figure 13:
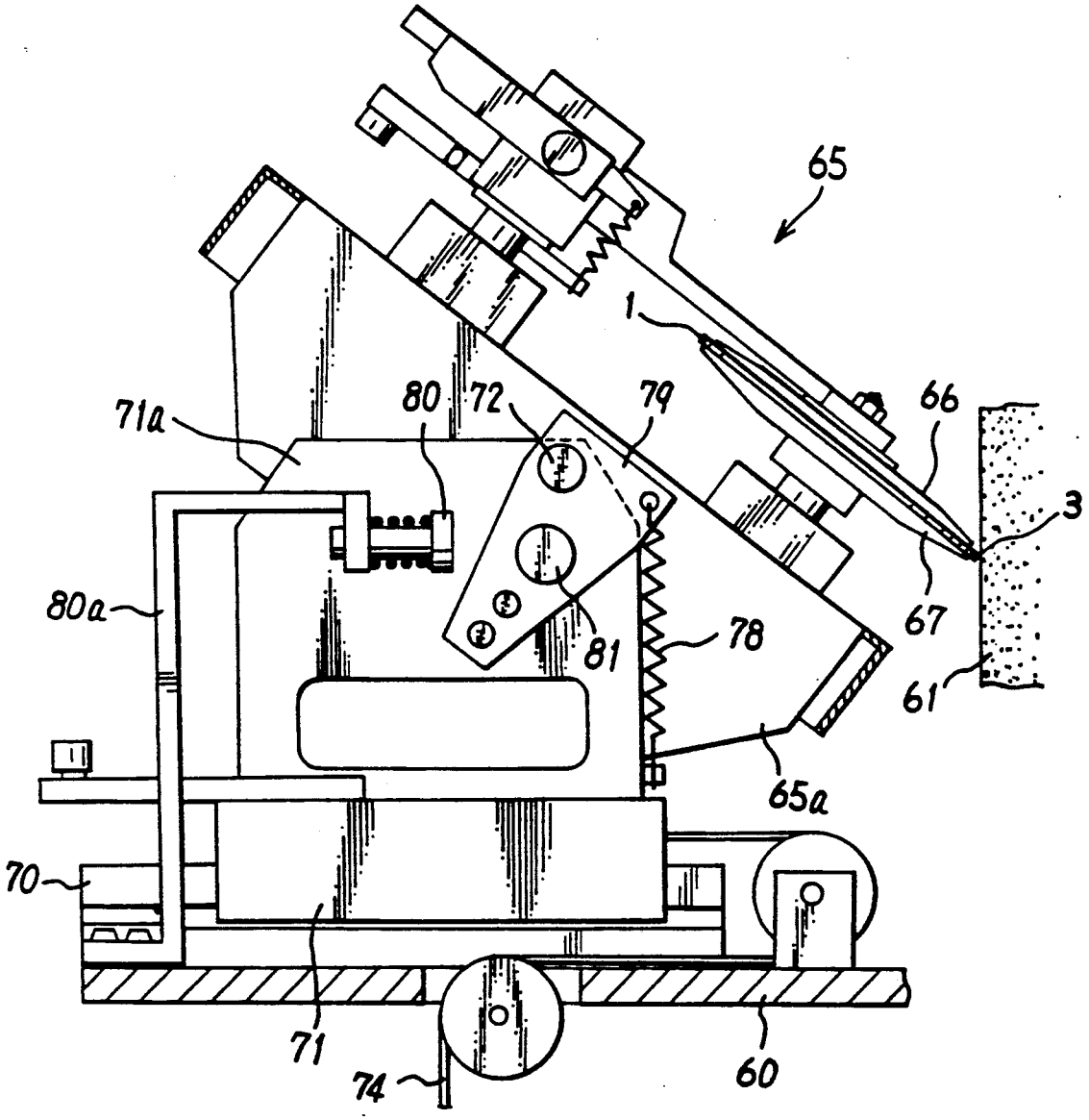

Further, except the one which is located in the work hand-over position A, each index unit 65 is constantly biased in the tilting direction by a tension spring 78, which is stretched between a plate member 79 fixed to the unit body 65*a* and the support wall 71*a* as shown in FIGS. 2 and 13, pressing the chamfered portion 3 of the work 1 against the polishing drum 61.

Figure 12:
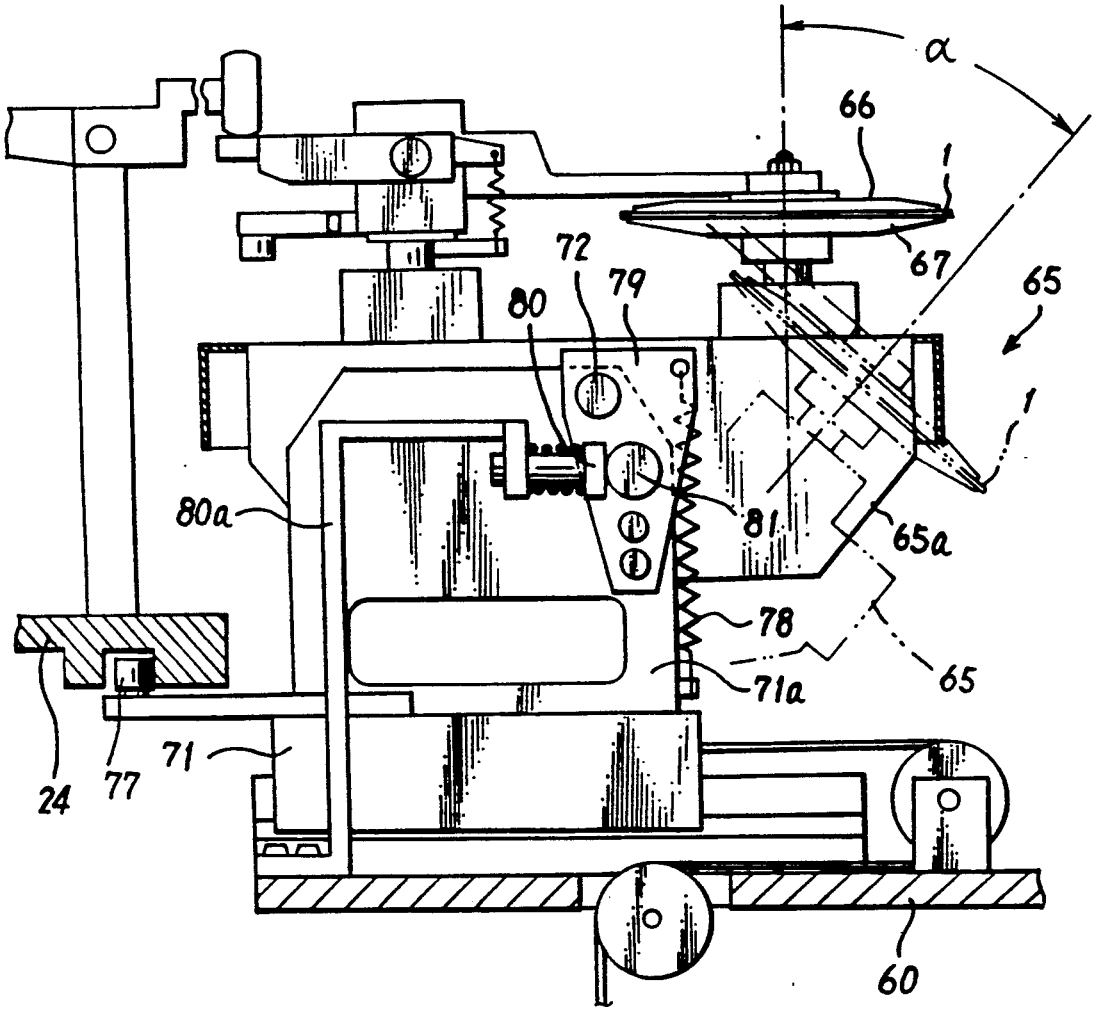
FIGS. 12 and 13 are side views in different positions of a tilt cancelling mechanism.

On the other hand, the index unit 65 in the work hand-over position A is maintained in horizontal state by the tilt cancelling mechanism which includes, as shown in FIG. 12, a stopper 80 mounted on a lateral side of each index unit 65 on the index table 60 through a support arm 80*a*, and a rocking block 81 fixed to the plate member 79 on the unit body 65*a* of the index unit 65. As an index unit 65 which is in the tilted position as shown in FIG. 13 is revolved to the work hand-over position A while being moved outward of the index table 60 by the above-described cam mechanism, the rocking block 81 of the index unit 65 is abutted against the stopper 80 and thereby pressed to turn the unit body 65*a* about the shaft 72 into horizontal position.

On the unit body 65*a* of each index unit 65, the above-described lower chuck member 67 is rotatably supported on a shaft 85 and rotationally driven from a motor 87 through gears 86*a* and 86*b*. A bearing member 88 is rotatably mounted on the base plate 65*b* of the unit body 65 through a support shaft 89, and an upper chuck arm 90 which rotatably supports the upper chuck member 66 at its fore end is rotatably supported on the bearing member 88 for rocking movement about a horizontal shaft 91. The upper chuck arm 90 is provided with a pressing roller mount surface 92 on its base portion, while the bearing member 88 is provided with an operating arm 93 for turning the bearing member 88 about the support shaft 89. The operating block 93 has an operating block 94 attached to the fore end thereof.

On the other hand, mounted vertically and horizontally at the work hand-over position of the machine frame 24 are a cylinder 100 for pushing down the upper chuck arm and a cylinder for turning the bearing member, respectively. Rod 100*a* of the upper chuck arm depressing cylinder 100 is connected to a link member 102 which is rockable about a shaft 103 and which has a roller 104 mounted at the fore end thereof for abutting engagement with the afore-mentioned roller mount surface 92. Rod 101*a* of the bearing turning cylinder 101 is provided with a pusher 105 to be abutted against the block 94 for pushing same.

Accordingly, upon stretching the rod 100*a* of the upper chuck arm depressing cylinder 100, the roller 104 is moved to depress the surface 92 on the base end portion of the arm 90, causing the latter to turn about the horizontal shaft 91 and as a result lifting up the fore end portion of the arm 90 to open the chuck member 66. By stretching the rod 101*a* of the bearing turning cylinder 101 in this state, the bearing member 88, namely, the upper chuck arm 90 is turned about the shaft 89 to move the upper chuck member 66 into a receded position indicated by chain line in FIG. 10. In this state, the polished work 1 is ejected from the first machining stage by the reversing mechanism 15 which will be described hereinlater, while supplying an untreated work 1 by the first transfer mechanism 14. For returning the arm 90 to the initial position, return springs 106 and 107 are interposed between the upper chuck arm 90 and support shaft 89 and between the support shaft 89 and unit body 65*a*, respectively.

Cracking of the work 1 which is pressed against the polishing drum in the machining stage can be prevented by forming the lower chuck member 67 of each index unit 65 in a larger diameter than the upper chuck member 66 as shown in FIG. 12. The work 1 can be protected against stains attributable to dryness or against corrosion by covering the chucking surfaces of the respective chuck members 66 and 67 with pads which are maintained constantly in wet state by showering.

The polishing drum 61 is formed by wrapping a polishing pad around the circumference of a drum body, and, as shown in FIGS. 1 to 3, driven from a motor which is mounted within a drum shaft 64 for forward and reverse rotations about a vertical axis. The drum 61 is also movable up and down in the axial direction integrally with the drum shaft 64 by operation of a lift means which is provided within the support arm 63. The support arm 63 on the support column 62 is lifted along the column 62 by a cylinder at the time of replacement of the polishing pad, and freely rotatable to turn the polishing drum 61 into an optimum working position.

Except a work contacting portion, the circumference of the polishing drum 61 is enclosed in a cover which prevent scattering of the polishing liquid. The polishing liquid stopped by the cover can be collected and recycled for the purpose of reducing its consumption for economic operations.

Figure 14:
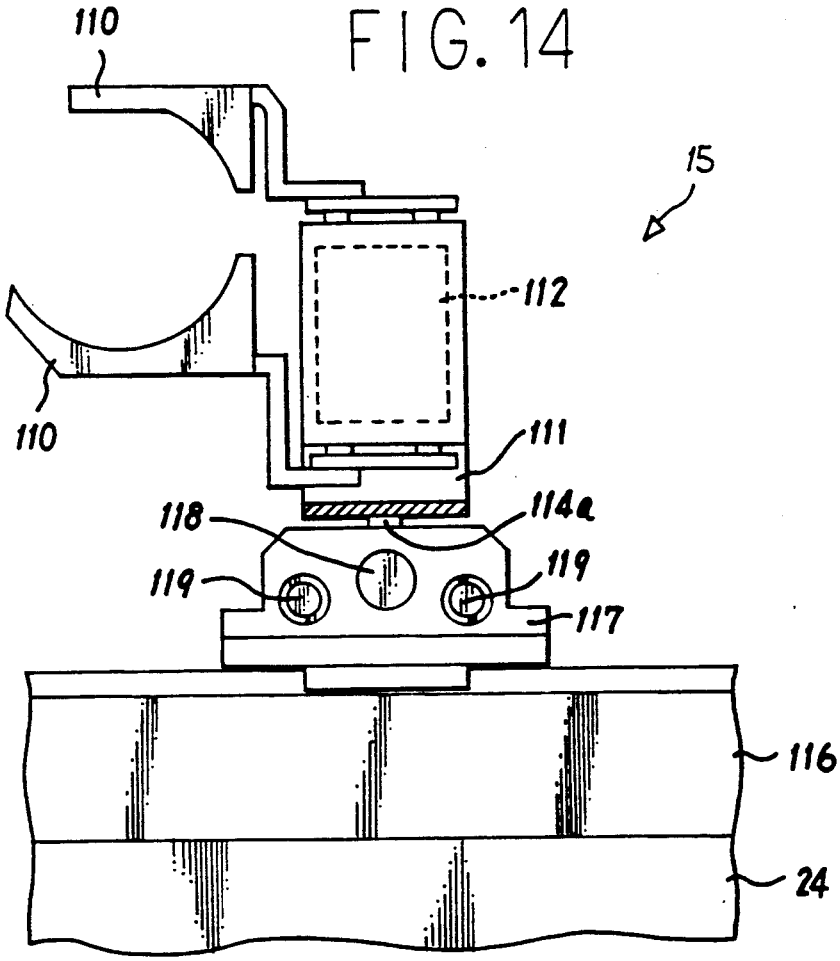
FIG. 14 is a schematic plan view of a reversing mechanism.
Figure 15:
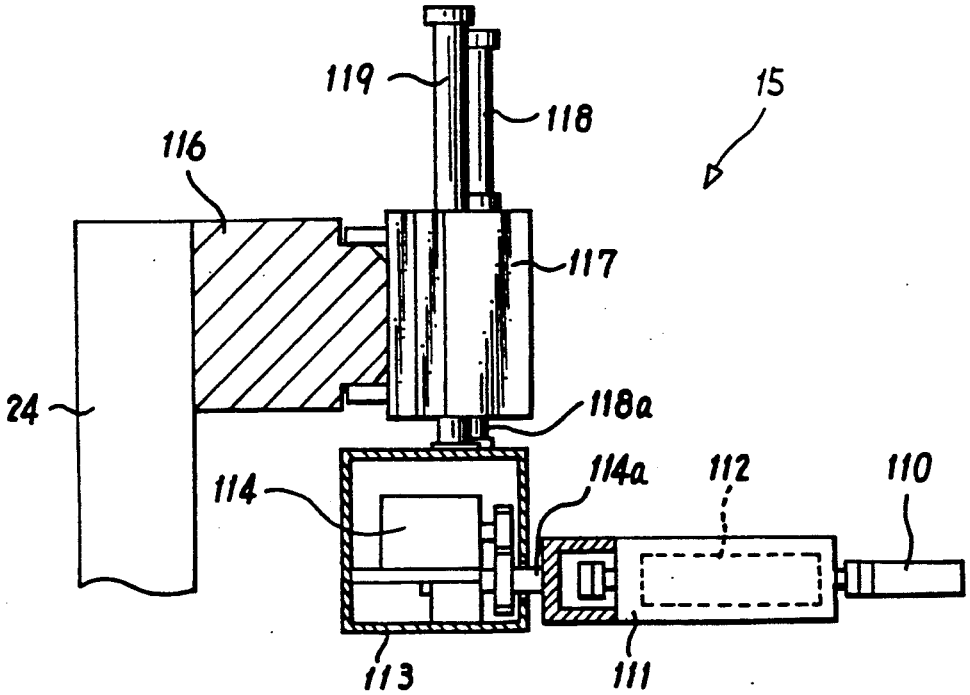
FIG. 15 is a fragmentary sectional view of the reversing mechanism.

As shown in FIGS. 14 and 15, the reversing mechanism 15 is provided with a pair of gripper members 110 which are mounted on a support member 111 and movable toward and away from each other by operation of a cylinder 112. The support member 111 is driven from a motor 114 on a base member 113 to turn upside down or vice versa about a shaft 114*a* together with a work 1 which is gripped between the two gripper members 110. The base member 113 is supported on a vertically movable rod 118*a* of a cylinder 118 which is mounted on a slide member 117 for movement along a rail 116 laid on the machine frame 24. In FIGS. 14 and 15, the reference numeral 119 denotes a guide rod which guides the vertical movements of the base member 113.

The second machining stage 13 is arranged substantially in the same manner as the above-described first machining stage 12, and the second transfer mechanism 16 has the same construction as the first transfer mechanism 14. Therefore, common major component parts are simply indicated by common reference numerals, without repeating the description.

The unloader section 17 which serves to unload polished works 1 includes, as shown in FIGS. 1 and 3, a pair of rails 121 for receiving a work 1 gripped on the second transfer mechanism 16, a pusher 123 for pushing a work 1 on the rails 121 into a cassette 122, a brushing mechanism 124 for washing the work 1 as it is being pushed into the cassette 122 by the pusher 123, and a ball screw for suspending the cassette 122 and lowering same step by step upon receipt of a work 1 to immerse the works 1 in a cleansing liquid. The pusher 123 is driven from a rodless cylinder 126 for movement along a guide rod 127. The brush mechanism 124 is provided with a pair of roller brushes 124*a* which are rotatable, gripping a work therebetween for washing same.

With an edge polisher arranged in the above-described manner, a work 1 which has been supplied onto the conveyer 22 from the cassette 20 of the loader section 10 is stopped at the position of the stopper 40, whereupon the chuck table 41 is lifted by the cylinder 42 and then turned after chucking the work 1. As soon as the orientation flat 2 of the work 1 is detected by the optical sensor 32, the chuck table 41 is stopped at that position to orient the work 1 in a predetermined direction.

The thus oriented work 1 is then sent to the first machining stage 12 by the first transfer mechanism 14 for supply to an index unit 65 in the work hand-over position A. By this time, the index unit 65 has been moved to the position outward of the index table 60 by the cam mechanism and maintained in horizontal state by the tilt cancelling mechanism. Further, as the work 1 is supplied onto the lower chuck member 67 by the first transfer mechanism 14, the upper chuck member 66 which has been opened and turned into the receded position by operation of the cylinders 100 and 101 is moved to a gripping position to hold the work 1 in cooperation with the lower chuck member 67. On the other hand, the index units 65 which are not in the work hand-over position A, namely, which are in the machining positions B to E are all tilted by a predetermined angle to press the chamfered edge portions 3 of the works 1 on the respective units against the polishing drum 61.

As soon as a work 1 is supplied to the index unit 65 in the work hand-over position, the index table 60 is turned through a predetermined angle in the arrowed direction (FIG. 1) to feed the respective index units by one pitch. The index unit 65 which has received the unpolished work 1 is moved to the first machining stage, while an index unit 65 in a fourth machining position is advanced to the work hand-over position A. In this instance, the index unit 65 in the work hand-over position A is gradually moved toward the center of the index table 60 into a first machining position B by the biasing force of the weight 75 under the guidance of the cam groove 76 and cam follower 77 of the cam mechanism, and at the same time gradually tilted toward the center of the index table 60 by the biasing force of the spring 78 under the guidance of the rocking block 81 and stopper 80 of the tilt cancelling mechanism, pressing the chamfered edge portion of the work 1 against the polishing drum 61. As soon as the index unit 65 reaches the first machining position B, the cam follower 77 and the rocking block 81 are completely disengaged from the cam groove 76 and the stopper 80, respectively. On the other hand, for moving the index unit 65 in the fourth machining position E to the work hand-over position A, it is gradually moved toward the outer end of the index table 60 by engagement of the cam follower 77 with the cam groove 76 and at the same time gradually turned into horizontal state by engagement of the rocking block 81 with the stopper 80 of the tilt cancelling mechanism.

In this manner, the chamfered edge portions 3 of the works 1 which are rotatably gripped by the upper and lower chuck members 66 and 67 of the index units 65 in the first to fourth machining position B to E are pressed against the rotating polishing drum 61 to undergo a polishing treatment. In the meantime, the polished work 1 on the index unit 65 in the work hand-over position A is ejected therefrom by the reversing mechanism 15, and succeedingly an unpolished work 1 is supplied thereto by the first transfer mechanism 14 in the same manner as described hereinbefore. At this time, the work 1 and the polishing drum 61 are both rotated clockwise or counterclockwise, reversing the direction of rotation every time the index table 60 is rotated by one pitch.

Figure 16:
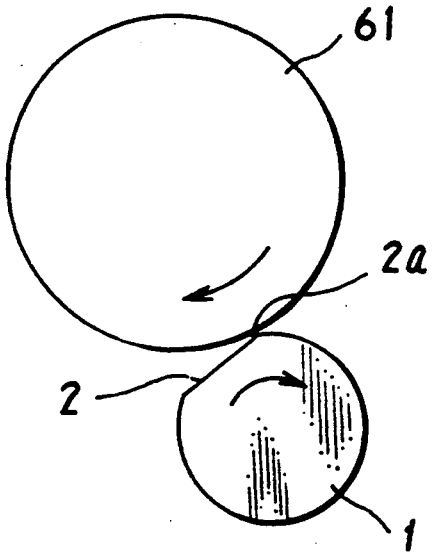
FIG. 16 is a schematic illustration explanatory of a polishing operation.

The reason why the rotational directions of the work 1 and the polishing drum 61 are reversed in the above-described manner is as follows. When the work 1 and the polishing drum 61 are put in rotation, the area of the work 1 which is in sliding contact with the polishing drum 61 is shifted along the arcuate portion of the work 1 as shown in FIG. 16. However, upon reaching one end 2*a* of the straight orientation flat 2 of the work 1, it becomes difficult for the index unit 65 to adapt its movement to such a variation in shape to a sufficient degree, loosening the contact between the work 1 and the polishing drum 61 at the end portion 2*a* of the orientation flat 2 and consequently resulting in an insufficient degree of polishing. For this reason, the rotational directions of the work 1 and the polishing drum 61 is reversed, re-polishing the work 1 from the end portion 2*a*.

The work 1 may be rotated at a constant speed during the polishing operation, but it is desirable to employ a lower rotational speed of the work when polishing the orientation flat 2 compared with the rotational speed when polishing other circumferential portions of the work.

The work 1 ejected by the reversing mechanism 15 is turned upside down by the gripper members 110 and supplied to an index unit 65 which is in the work hand-over position for the second machining stage 13.

In the second machining stage 13, the chamfered edge portion on the other side of the work 1 is pressed against the polishing drum 61 to undergo a polishing treatment in the same manner as in the above-described first machining stage.

Upon completing polishing of both sides of the work 1, it is ejected from the index unit 65 in the work hand-over position A by the second transfer mechanism 16 and placed on the rail 121 in the unloader section 17. Whereupon, the work 1 is pushed along the rail 121 by the pusher 123 and, after being washed through the brush mechanism 124, pushed into the cassette 122 which is lowered step by step to immerse the work 1 in a cleaning liquid.

Figure 4B:
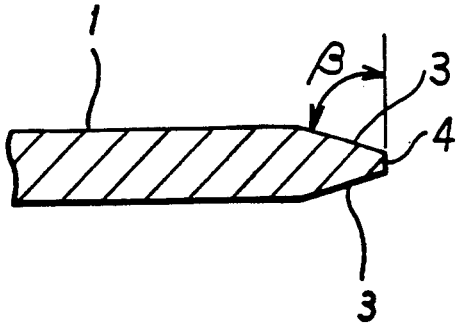
FIG. 4(B) is a fragmentary section of the wafer.

In this instance, the tilting angle $\alpha$ (FIG. 12) of the index unit 65 is determined depending upon the bevel angle $\beta$ (FIG. 4(B)) of the work 1. By selecting a tilt angle $\alpha$ at which both of the chamfered portion 3 and part of the side surface 4 of the work 1 on the side of the chamfered portion 3 are simultaneously polished due to resiliency of the polishing pad on the drum 61, it becomes possible to finish the polishing of the side surface 4 concurrently with the first and second polishing treatments of the chamfered portions before and after the reversal of the work 1.

Needless to say, the edge polisher according to the present invention can polish not only works of incomplete circular shapes with an orientation flat as described hereinbefore, but also works of other shapes, for example, works of complete circular shapes, elliptic or square shapes or other arbitrary shapes. When treating works of a complete circular shape, the function of the sensor 44 of the positioning mechanism 11 may be turned off or eliminated, if desired, stopping a work in a predetermined position by abutment against an arcuate portion 40*a* of the stopper 40.

What is claimed is:

1. An edge polisher, comprising in combination:

a loader section for feeding works each having chamfered edge portions on the opposite sides thereof;

a positioning mechanism for arraying said works in a predetermined stand-by position;

first and second machining stages each having an index table adapted to rotate intermittently through a predetermined angle, a plural number of index units each having a motor-driven work chuck means and located at predetermined angular intervals about the center of rotation of said index table, and a polishing drum located at the center of rotation of said index table and rotationally driven from a motor, each one of said index units being revolved around said polishing drum by rotation of said index table, pressing a chamfered edge portion of a work on said chuck means against said polishing drum;

a first transfer mechanism adapted to transfer said works in said predetermined stand-by position successively to said index units in said first machining stage;

a reversing mechanism adapted to reverse the sides of said works upside down one after another upon finishing a polishing treatment on said chamfered edge portion in said first machining stage;

a second transfer mechanism adapted to eject said works one after another upon finishing a polishing treatment on said chamfered edge portion in said second machining stage; and an unloader section for unloading polished works received from said second transfer mechanism.

2. An edge polisher as defined in claim 1, wherein said positioning mechanism includes a rotatable chuck table adapted to releasably hold a work for delivery to said stand-by position, and a sensor means for detecting an orientation flat of said work, stopping the rotation of said chuck table at a position where said orientation flat is detected.

3. An edge polisher as defined in claim 1, wherein each one of said index units in said first and second machining stages includes a support wall movable along a rail extending in a radial direction of said index table, and a unit body having said chuck means and tiltably mounted on said support wall, said index unit and unit body being biased toward the center of said index table and in the tilting direction, respectively, thereby pressing the chamfered portion of a works against said polishing drum except an index unit in a work hand-over position, and said index unit in said work hand-over position being moved toward the outer periphery of said index table by a carrier means while having the posture of said unit body adjusted into horizontal stage by a tilt cancelling mechanism.

4. An edge polisher as defined in claim 3, wherein said biasing means urging said unit body in the tilting direction comprises a tension spring stretched between said unit body and said support wall.

5. An edge polisher as defined in claim 3, wherein said biasing means urging said index unit toward the center of said index table comprises a weight attached to the fore end of a rope having the base end thereof fixed to said index unit.

6. An edge polisher as defined in claim 3, wherein said index table comprises a pin member movable into a protruded position when a work is not gripped in said chuck means of said index unit, thereby restricting the movement of said index unit to prevent said chuck means from hitting against said polishing drum.

7. An edge polisher as defined in claim 3, wherein said carrier means moving said index unit toward the outer periphery of said index table comprises a cam groove, and a cam follower provided on the part of said index unit, said cam and cam follower being engaged with each other when said index unit is in said work hand-over position.

8. An edge polisher as defined in claim 3 or 7, wherein said tilt cancelling mechanism of said index unit comprises a stopper mounted on said index table, and a rocking block mounted on said unit body, said rocking block being abutted against said stopper to adjust the posture of said unit body into horizontal state when said index unit is revolved to said work hand-over position and moved toward the outer periphery of said index table.

9. An edge polisher as defined in claim 1, wherein said work chuck means on said index unit comprises a pair of upper and lower circular chuck members movable toward and away from each other to hold a work from the opposite sides thereof.

10. An edge polisher as defined in claim 9, wherein said lower chuck member is formed in a larger diameter than said upper chuck member.

11. An edge polisher as defined in claim 1, wherein the rotational directions of said work chuck means on said index unit and said polishing drum are reversed every time said index table is turned by one pitch.

12. An edge polisher as defined in claim 1, wherein said first and second transfer mechanisms are provided with a pair of gripper members openably closable by an actuator and adapted to hold a work at radially opposite circumferential surfaces thereof.

13. An edge polisher as defined in claim 1, wherein said reversing mechanism is provided with a pair of gripper members openably closable by an actuator and at the same time turnable upside down, and adapted to hold a work at radially opposite circumferential surfaces thereof.

14. An edge polisher as defined in claim 1, wherein said unloader section comprises a brush mechanism for washing polished works, a work receptacle cassette adapted to be lowered step by step upon receipt of a work, and a bath holding a cleaning liquid for immersing said cassette therein.

* * * * *